US010774614B2

(12) United States Patent
Ringgenberg

(10) Patent No.: US 10,774,614 B2
(45) Date of Patent: Sep. 15, 2020

(54) DOWNHOLE TOOL WITH ASSEMBLY FOR DETERMINING SEAL INTEGRITY

(71) Applicant: Halliburton Energy Services, Inc., Houston, TX (US)

(72) Inventor: Paul D. Ringgenberg, Frisco, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 225 days.

(21) Appl. No.: 15/752,785

(22) PCT Filed: Sep. 22, 2015

(86) PCT No.: PCT/US2015/051472
§ 371 (c)(1),
(2) Date: Feb. 14, 2018

(87) PCT Pub. No.: WO2017/052511
PCT Pub. Date: Mar. 30, 2017

(65) Prior Publication Data

US 2018/0238141 A1 Aug. 23, 2018

(51) Int. Cl.

| | |
|---|---|
| ***E21B 47/10*** | (2012.01) |
| ***E21B 34/06*** | (2006.01) |
| ***E21B 47/06*** | (2012.01) |
| ***E21B 47/07*** | (2012.01) |

(52) U.S. Cl.
CPC ..... *E21B 34/063* (2013.01); *E21B 47/06* (2013.01); *E21B 47/07* (2020.05); *E21B 47/10* (2013.01); *E21B 2200/06* (2020.05)

(58) Field of Classification Search
CPC ..... E21B 47/1005; E21B 47/1025; E21B 47/0065; G01M 3/02
See application file for complete search history.

(56) References Cited

U.S. PATENT DOCUMENTS 2,658,724 A * 11/1953 Arps ..... E21B 12/02 175/41
4,346,591 A * 8/1982 Evans ..... E21B 12/02 175/39
4,673,926 A * 6/1987 Gorman ..... G01M 3/045 340/605
4,802,143 A * 1/1989 Smith ..... E21B 21/08 175/40

(Continued)

FOREIGN PATENT DOCUMENTS

WO 2014143003 9/2014

OTHER PUBLICATIONS

International Search Report and Written Opinion of PCT Application No. PCT/US2015/051472 dated May 24, 2016: pp. 1-17.

*Primary Examiner* — Shane Bomar
*Assistant Examiner* — Steven A MacDonald
(74) *Attorney, Agent, or Firm* — Charmberlain Hrdlicka

(57) ABSTRACT

A downhole well device for positioning within a well having a fluid, comprising an outer casing comprising a port, an inner casing at least partially located within the outer casing, seals between the inner casing and the outer casing, a rupture disk located in the port, a substance located in a space between the rupture disk and the inner casing, wherein the substance is exothermically reactive with the fluid, and a sensor configured to detect an exothermic reaction within the chamber.

15 Claims, 3 Drawing Sheets

(56) References Cited

U.S. PATENT DOCUMENTS

| | | | | |
|---|---|---|---|---|
| 5,411,049 | A * | 5/1995 | Colvard | E21B 21/10 137/71 |
| 5,647,435 | A * | 7/1997 | Owens | E21B 47/011 166/250.01 |
| 6,430,990 | B1 | 8/2002 | Mallet | |
| 9,593,546 | B2 * | 3/2017 | Wright | E21B 23/04 |
| 10,415,381 | B2 * | 9/2019 | Samec | E21B 49/088 |
| 2002/0064206 | A1 * | 5/2002 | Gysling | E21B 47/065 374/147 |
| 2004/0011525 | A1 * | 1/2004 | Jones | E21B 17/1014 166/264 |
| 2007/0234788 | A1 * | 10/2007 | Glasbergen | E21B 47/065 73/152.12 |
| 2008/0066537 | A1 | 3/2008 | Hegeman et al. | |
| 2014/0299316 | A1 | 10/2014 | Needham | |
| 2014/0311736 | A1 | 10/2014 | Pipchuk et al. | |
| 2014/0318770 | A1 * | 10/2014 | Hallundbæk | E21B 47/06 166/250.12 |
| 2014/0318809 | A1 * | 10/2014 | Joensen | E21B 17/02 166/380 |
| 2016/0215617 | A1 * | 7/2016 | Samec | E21B 49/10 |
| 2017/0037712 | A1 * | 2/2017 | Davidson | F42D 1/00 |
| 2018/0179886 | A1 * | 6/2018 | Espe | E21B 33/1208 |
| 2019/0071965 | A1 * | 3/2019 | Jaaskelainen | E21B 47/06 |

* cited by examiner

DOWNHOLE TOOL WITH ASSEMBLY FOR DETERMINING SEAL INTEGRITY

BACKGROUND

This section is intended to provide background information to facilitate a better understanding of the various aspects of the described embodiments. Accordingly, it should be understood that these statements are to be read in this light and not as admissions of prior art.

Wells are drilled at various depths to access and produce oil, gas, minerals, and other naturally-occurring deposits from subterranean geological formations. The drilling of a well is typically accomplished with a drill bit that is rotated within the well to advance the well by removing topsoil, sand, clay, limestone, calcites, dolomites, or other materials. The drill bit is attached to a drill string that may be rotated to drive the drill bit and within which drilling fluid, referred to as "drilling mud" or "mud," may be delivered downhole. The drilling mud is used to cool and lubricate the drill bit and downhole equipment and is also used to transport any rock fragments or other cuttings to the surface of the well. The drill string may include a bottom hole assembly (BHA) that includes various electronic tools such as motors, directional sensing devices, generators, and the like.

As wells are established it is often useful to obtain information about the well and the geological formations through which the well passes. Information gathering may be performed using tools that are delivered downhole by wireline, tools coupled to or integrated into the drill string, or tools delivered on other types of testing strings. These tools may include logging while drilling (LWD) and measurement while drilling (MWD) tools. Testing strings, which may be used to test a well, include tools such as tester valves, circulations valves, and the like. Many of these downhole tools and devices include regions which need to remain sealed and isolated from fluid that may be present in the downhole environment.

BRIEF DESCRIPTION OF THE DRAWINGS

For a detailed description of the embodiments of the invention, reference will now be made to the accompanying drawings in which.

DETAILED DESCRIPTION

The present disclosure provides methods and systems for determining seal integrity in downhole tools. Specifically, the present disclosure provides techniques in which materials that react exothermically with water are placed inside regions of downhole tools where fluids are not to be present. One or more sensors can be used to detect the occurrence of an exothermic reaction, which is an indication of breach of the sealed region. One option is to include the sensor externally of the tool. Placement of the sensor externally of the tool allows for indication of the breach without requiring additional ports or intrusive devices. For illustrative purposes, the present techniques are described in the context of a circulation valve of a well testing string. However, the present techniques can be used with any downhole tool for the detection of the presence of fluid within a region.

Figure 1:
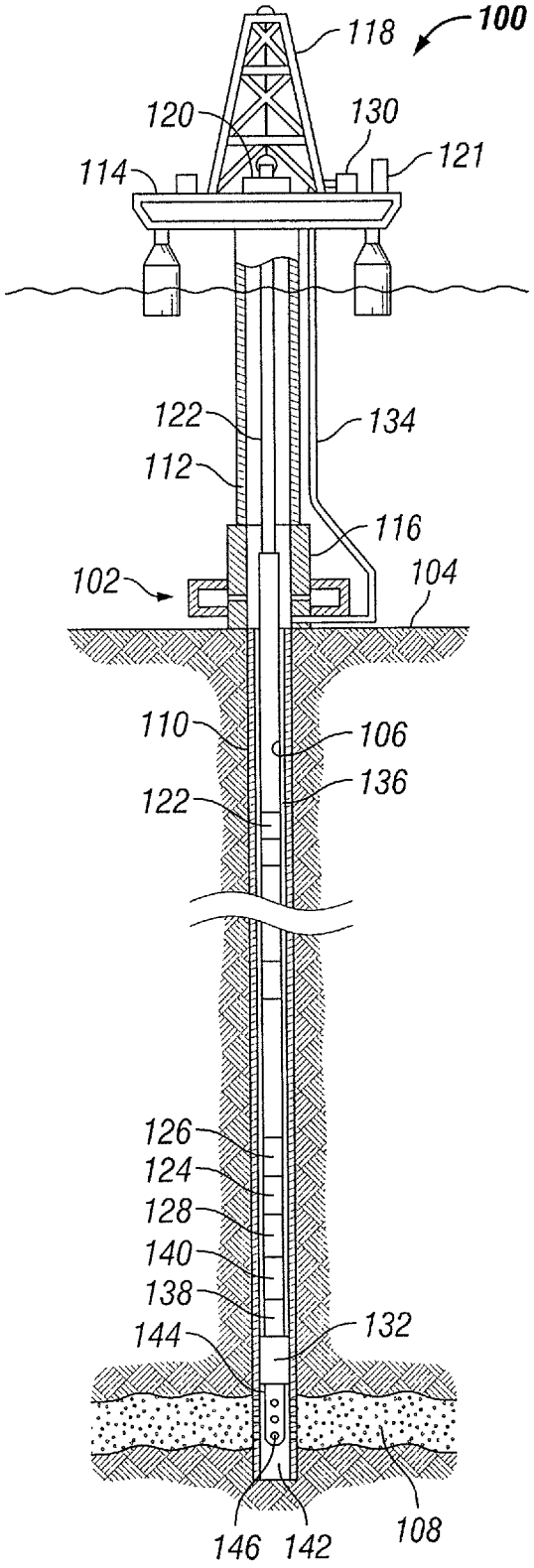
FIG. 1 depicts a schematic view of an offshore well with a well tubing string, in accordance with one or more embodiments.

Referring to the figures, FIG. 1 depicts a schematic view of an offshore well system 100 with a tubing string 122 in an oil and gas well 102, in accordance with one or more embodiments. Specifically, in some applications, the tubing string 122 is a well testing string. A floating platform 100 is positioned over the submerged oil or gas well 102 located in the sea floor 104. The well 102 includes a wellbore 106 that extends from the sea floor 104 to a submerged formation 108 to be tested. The wellbore 106 may be lined by a casing 110 that may be cemented into place. A subsea conduit 112 extends from a deck 114 of the floating platform 100 into a wellhead installation 116. The floating platform 100 further includes a derrick 118 and a hoisting apparatus 120 for raising and lowering tools to drill, test, and complete the oil or gas well 102. While the well 102 is illustrated as being an offshore well in FIG. 1, the systems, apparatuses, and methods described herein will function equally well in an on-shore well.

In some embodiments, the tubing string 122 is lowered into the wellbore 106. The tubing string 122 may include such tools as a slip joint 123 to compensate for the wave action of the floating platform 100 as the tubing string 122 is lowered into place. The tubing string 122 may also include a tester valve 124, and a circulation valve 126.

The tester valve 124 is used to control the flow from the formation 104 and provides a downhole closure method to stop the flow. For example, for reservoir pressure transient analysis, it is much preferred to shut in the well downhole instead of at the surface. For a surface shut in, tubing from the surface to the formation is pressurized by the formation so the actual reservoir pressure response is masked.

In certain embodiments, the circulation valve 126 may be used to control fluid communication between the annulus 136 and the inside of the tubing string 122, as will be describe in more detail below with respect to FIG. 3.

The tester valve 124, the circulation valve 126, and the check valve assembly 128 may be operated by fluid annulus pressure exerted by a pump 130 on the deck 114 of the floating platform 100. Pressure changes are transmitted by a pipe 134 to a well annulus 136 between the casing 110 and the tubing string 122. Well annulus pressure is isolated from the formation 108 by a packer 138 having an expandable sealing element 132 thereabout set in the casing 110 adjacent to the formation 108. The packer 138 may be any suitable packer type.

The tubing string 122 may also include a tubing seal assembly 140 at the lower end of the tubing string 122. The tubing seal assembly 140 stabs through a passageway within the packer 138 to form a seal isolating the well annulus 136 above the packer 138 from an interior bore portion 142 of the well immediately adjacent the formation 108 and below the packer 138.

A perforated tail piece 144, a Tubing Conveyed Perforating (TCP) gun, or other production tube, can be located at the bottom end of the tubing seal assembly 140 to allow formation fluids to flow from the formation 108 into the flow passage of the tubing string 122. Formation fluid is admitted into the interior bore portion 142 through perforations 146 provided in the casing 110 adjacent the formation 108.

A formation test procedure controls the flow of fluid from the formation 108 through the flow channel in the tubing string 122 by applying and releasing fluid annulus pressure to the well annulus 136 by the pump 130 to operate the tester valve 124, the circulation valve 126. The formation test may measure the pressure build-up curves and fluid temperature curves with appropriate pressure and temperature sensors in the tubing string 122. The system 100 also includes an above-surface control center 121 configured to transmit and receive data with one or more downhole tools.

Figure 2:
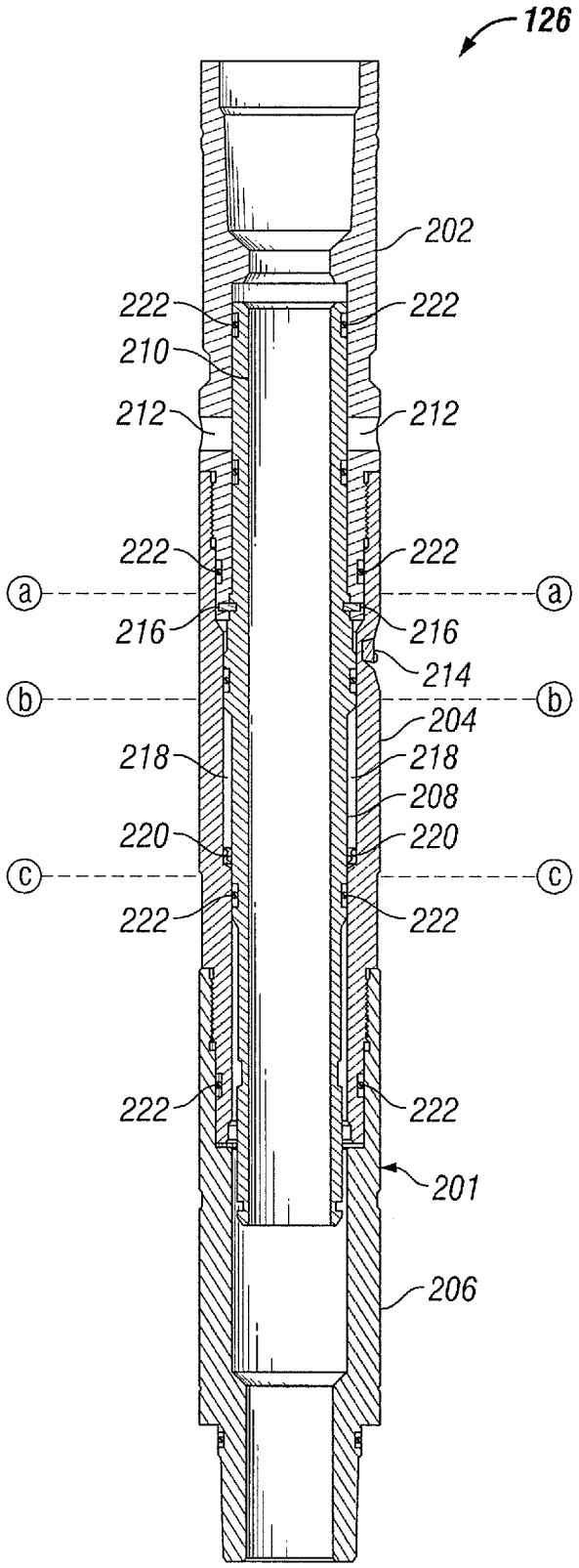
FIG. 2 depicts a cross-sectional schematic view of a circulating valve, in accordance with one or more embodiments.

FIG. 2 depicts a cross-sectional schematic view of the circulating valve 126, in accordance with one or more embodiments. The circulating valve assembly 126 generally has a tubular body and may be installed as a segment of the tubing string 122 and comprising a bore in fluid communication with the tubing string 122. The circulating valve 126 includes an upper coupling 202, a rupture disc case 204, a lower adapter 206, and an inner mandrel 208, each of which may be tubular shaped. The upper coupling 202 is configured to couple to a portion of the tubing string 122 above the circulating valve 126, the lower adapter 206 is configured to couple to a portion of the tubing string 122 below the circulating valve 126, and the rupture disc case 204 is coupled between upper coupling 202 and the lower adapter 206. The inner mandrel 208 is located inside the circulating valve 126. The upper coupling 202, rupture disc case 204, and lower adapter 206 may make up an outer casing 201 of the circulating valve 126.

The circulating valve 126 is typically run installed in the wellbore 106 connected to the tubing string 122. The annulus 136 is formed inside the casing 110 wellbore 106 around the circulating valve 126. The circulating valve 126 is positioned above of the packer 138. In this embodiment, the valve assembly has an external shape and size that is substantially the same size and shape as the tubing string. The bore 210 allows tools to pass therethrough.

The circulating valve 126 is movable between two configurations, a sealed configuration and a circulating configuration. FIG. 2 illustrates the circulating valve 126 in the sealed configuration, in which the bore 106 of the circulating valve 126 is sealed off from the annulus 136. The circulating valve 126, along with the tubing string 122, is run into the wellbore 106 with the circulating valve 126 in the run position. When in position at a subterranean location, the packer 138 is set against the well casing 110, sealing the annulus 136 formed between the outside of the tubing string 122 and the interior wall of the surrounding casing to prevent flow through the annulus past the packer 138.

In the sealed position, the inner mandrel 208 blocks one or more ports 212 formed in the upper coupling 202. In the circulating position, the inner mandrel 208 moves axially relative to the outer casing 201 from the sealed position. When the inner mandrel 208 is in the circulating position, the one or more ports 202 are no longer blocked, putting the annulus 136 in fluid communication with the bore 210 via the ports 202. With the circulating valve 126 in the circulating position, fluids, such as for example, drilling mud or produced hydrocarbons can be circulated or pumped out of the wellbore 106 either through the annulus 136 or the interior of the tubing string 122 via the circulating valve 126.

In some embodiments, the circulating valve 126 is put into the circulating position from the sealed position when the pressure in the annulus 136 reaches a threshold level. Specifically, the circulating valve 126 comprises a rupture disc 214 located in the wall of the rupture disc case 204. The rupture disc 214 is exposed to the annulus 136, separating the annulus 136 from the inner mandrel 208, and therefore subject to the annulus pressure. The rupture disc 214 is configured to rupture when the annulus pressure reaches the threshold. When the rupture disc 214 ruptures, the inner mandrel 208 is exposed to the annulus pressure. The rupture disc 214 can be specifically designed or chosen to rupture at the threshold pressure. The annulus pressure then pushes the inner mandrel 208 from the sealed position to the circulating position, causing one or more shear pins 214 to shear. In the embodiment of FIG. 2, the annulus pressure pushes the inner mandrel 208 downward, exposing the ports 212.

The circulating valve 126 further includes one or more air chambers 218 bound between the rupture disc case 204 and the inner mandrel 208. When the circulating valve 126 is in the sealed configuration, the air chamber 218 is at its full volume. When the circulating valve 126 is put into the circulating configuration, the inner mandrel 208 travels into the space held by the air chamber 218, thereby collapsing the air chamber 218. In some embodiments, one or more bumpers 220 are located in the air chamber 218 and configured to cushion the inner mandrel 208 as it travels through the air chamber 218. The circulating valve 126 further includes seals 222 disposed between the inner mandrel 208 and the outer casing 201 to prevent fluid breach.

Certain regions of the circulating valve 128, such as the air chamber and regions adjacent the rupture disc 214 should remain sealed against surrounding fluids while in the sealed configuration. In order to detect if any of these regions has been breached by fluid, a substance 306 that reacts exothermically with water is placed in one or more of the regions. For example, the substance 306 can be placed near the rupture disc 214 or within the air chamber 218, as further discussed with respect to FIGS. 3 and 4. The substance 306 may contain any material that reacts exothermically with water. This may include, but is not limited to, alkali metals and alkaline earth metals. The substance 306 may include a strong acid such as sulfuric acid, anhydrous salt, calcium chloride, and the like. In some embodiments, the substance 306 may be configured to react exothermically with a fluid besides water, such as hydrocarbon. In some embodiments, the substance 306 may be one that reacts endothermically with water.

In some embodiments, the substance 306 may include two or more substances that are highly reactive to each other, but require the addition of the water to allow them to mix and react. In another embodiment, both the rupture disc case 204 and the mandrel 208 are made of a non-magnetic material, and magnetic particles are suspended in a salt type ring. When water is not present, the magnetic particles are held in the salt and equally spaced. If water breaches the air chamber 218, the salt dissolves, causing the magnetic particles to bunch together. A magnetometer can be used to detect such an occurrence, indicating breach of the air chamber 218.

Figure 3:
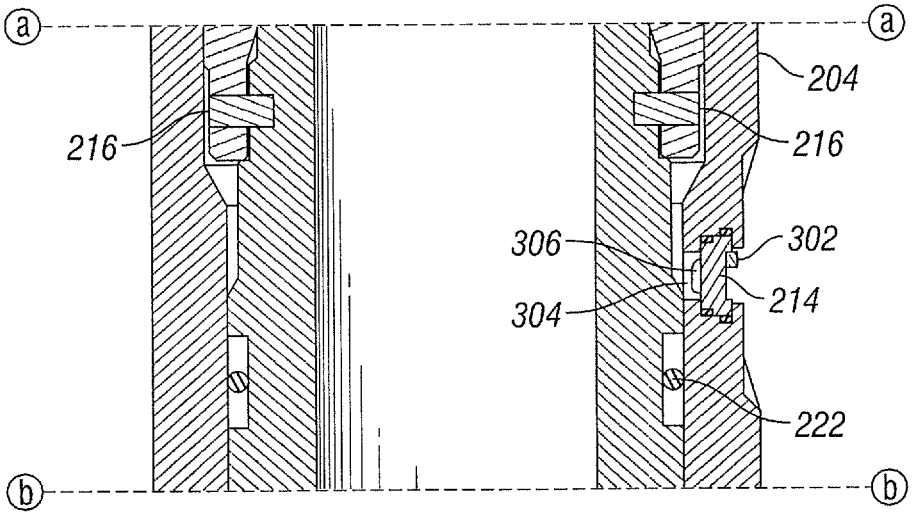
FIG. 3 depicts a cross-sectional schematic view of a rupture seal section of the circulating valve of FIG. 2.

FIG. 3 depicts a cross-sectional schematic view of a rupture disc section of the circulating valve 128 of FIG. 2, specifically section a-b of FIG. 2. In some embodiments, the rupture disc 214 is formed in the wall of the rupture disc case 204. Specifically, the rupture disc 214 may located within an orifice 304 formed within the rupture disc case 204 such that when the rupture disc 214 breaks, the orifice will be partially open to flow. However, when the circulating valve 128 is in the sealed configuration, no rupture disc 214 should be intact and prevent fluid from penetrating the circulating valve 128. Thus, the substance can be placed adjacent the rupture disc 214 on the inside of the circulating valve 128 such that if any fluid were to leak past the rupture disc 214, an exothermic reaction would take place. The substance may be placed on or near the seam between the rupture disc 214 and the rupture disc case 204 in the orifice 304, and any other suitable location in fluid communication with the rupture disc 214. Thus, the seal integrity of the rupture disc 214 can be tested.

A sensor 302, such as a temperature sensor, may be placed on the rupture disc 214 or rupture disc case 204 external to the circulating valve 128. The sensor 302 is configured to monitor a certain parameter and detect occurrence of an exothermic reaction. For example, a temperature sensor placed on the outside of the rupture disc 214 or rupture disc case 204 can detect occurrence of an exothermic reaction by sensing a sudden temperature rise. The sensor 302 may be a pressure sensor configured to detect a rise in pressure caused by and indicative of an exothermic reaction. The sensor 302 may produce an indication of a leak or communicate to the control center 121, where an indication is produced. The tool may then be disassembled to determine the cause of the leak or to fix the leak.

Figure 4:
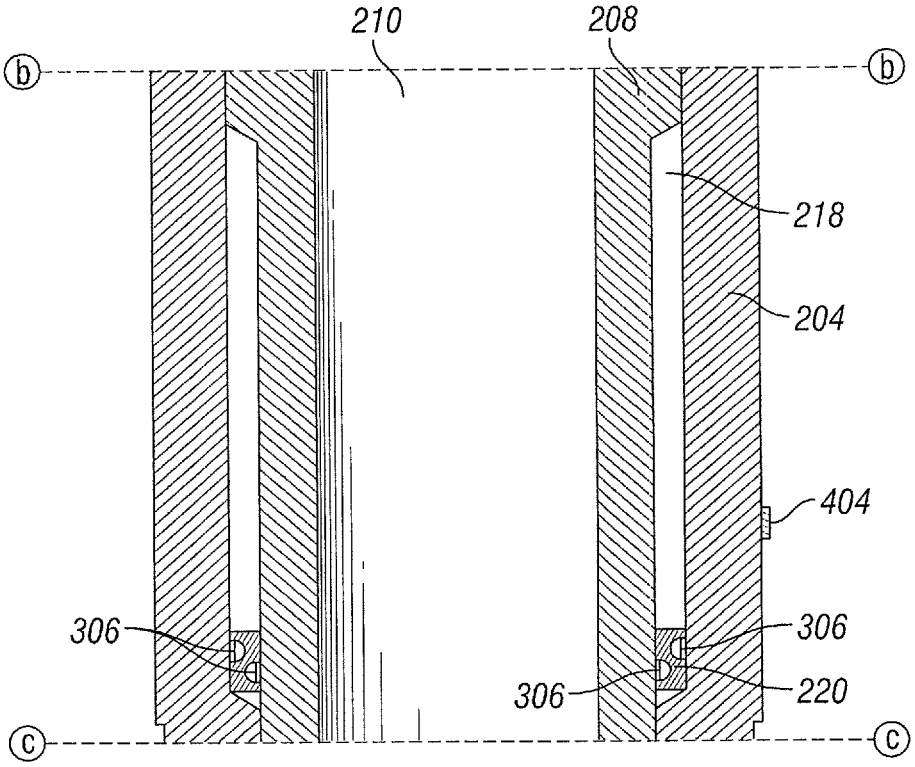
FIG. 4 depicts a cross-sectional schematic view of an air chamber section of the circulating valve of FIG. 2.

FIG. 4 depicts a cross-sectional schematic view of an air chamber section of the circulating valve of FIG. 2, specifically section b-c of FIG. 2. The air chamber 218 is formed between the inner mandrel 208 and the rupture disc case 304. In some embodiments, the air chamber 218 may be formed in a recess in the inner mandrel 208. Typically, the air chamber 218 should be kept sealed from any fluid entry such that the volume is available for receiving the inner mandrel 20 when it slides into the second position when the circulating valve 128 is put into the circulating configuration. In order to detect fluid leak into the air chamber 218, the substance 306 can be placed in the air chamber 218 such that an exothermic reaction occurs if fluid enters the air chamber 218. In some embodiments, the substance 306 can be placed in the bumpers 220. In certain such embodiments, the substance 306 is to be applied to the bumper 220 prior to assembly, and the bumper 220 with the substance 306 is then installed into the circulating valve 128. In other embodiments, the substance 306 can be applied to other areas of the air chambers 218.

In certain such embodiments, a sensor 404, similar to sensor 302, may be placed on the rupture disc case 204 external to the circulating valve 128 to monitor a certain parameter and detect occurrence of an exothermic reaction. For example, a temperature sensor can detect occurrence of an exothermic reaction by sensing a sudden temperature rise. The sensor 404 may be a pressure sensor configured to detect a rise in pressure caused by and indicative of an exothermic reaction. The sensor 404 may communicate the sensed data or notifications to the above-surface control center 121, where an indication is produced. Various intervention steps can then be taken as suitable for the operation.

The embodiments discussed herein apply to a circulation valve 128. However, the technique disclosed herein of applying a substance that reacts exothermically with a fluid such as water can be used to detect the presence of a certain material, such as water, within any type of downhole tool that has a region to be isolated.

In addition to the embodiments described above, many examples of specific combinations are within the scope of the disclosure, some of which are detailed below:

Example 1

A downhole well device for positioning within a well having a fluid, comprising:

a sealed chamber;

a substance located within the chamber, wherein the substance is exothermically or endothermically reactive with the fluid; and a sensor configured to detect an exothermic reaction or endothermic reaction within the chamber.

Example 2

The device of example 1, wherein the sensor comprises a temperature sensor, a pressure sensor, or both.

Example 3

The device of example 1, further comprising:

an outer casing;

an inner casing at least partially located within the outer casing;

seals between the outer and inner casing;

wherein the sealed chamber is formed by the outer and inner casings and the seals; and wherein the temperature sensor is located on an outer surface of the outer casing and is configured to sense the temperature of the chamber.

Example 4

The device of example 1, further comprising a bumper located in the chamber, wherein the substance is located on the bumper or is a part of the bumper.

Example 5

The device of example 1, wherein the inner casing is movable axially with respect to the outer casing.

Example 6

The device of example 1, wherein the inner casing comprises a mandrel.

Example 7

The device of example 1, wherein the substance comprises at least one of alkali metal and an alkaline earth metal.

Example 8

The device of example 1, wherein the outer casing is coupled to a downhole tubing string or a downhole tubing string.

Example 9

The device of example 9, wherein the fluid is water.

Example 10

A downhole well device for positioning within a well having a fluid, comprising:

an outer casing comprising a port;

an inner casing at least partially located within the outer casing;

seals between the inner casing and the outer casing;

a rupture disk located in the port;

a substance located in a space between the rupture disk and the inner casing, wherein the substance is exothermically reactive with the fluid; and a sensor configured to detect an exothermic reaction within the chamber.

Example 11

The device of example 10, wherein the sensor comprises a temperature sensor, a pressure sensor, or both.

Example 12

The device of example 11, wherein the temperature sensor is located external to the outer casing adjacent the rupture disk and configured to sense the temperature of the space externally.

Example 13

The device of example 10, wherein the substance comprises at least one of an alkali metal and an alkaline earth meter.

Example 14

The device of example 10, wherein the substance is located on the rupture disk.

Example 15

The device of example 10, wherein the inner casing is movable axially with respect to the outer casing.

Example 16

The device of example 10, wherein the fluid is water.

Example 17

A method of detecting a leak into sealed chamber of a downhole well tool, comprising:

sensing a condition of the sealed chamber with a sensor;

detecting an indication of an exothermic reaction within the sealed chamber, the exothermic reaction resulting from a fluid being present in the sealed chamber; and producing an indication upon detection of the exothermic reaction.

Example 18

The method of example 17, comprising sensing a temperature of the sealed chamber externally and detecting a rise in temperature, wherein the rise in temperature is indicative of the exothermic reaction.

Example 19

The method of example 17, wherein the sealed chamber contains a substance configured to react exothermically in the presence of the fluid.

Example 20

The method of example 19, wherein the fluid is water.

This discussion is directed to various embodiments of the invention. The drawing figures are not necessarily to scale. Certain features of the embodiments may be shown exaggerated in scale or in somewhat schematic form and some details of conventional elements may not be shown in the interest of clarity and conciseness. Although one or more of these embodiments may be preferred, the embodiments disclosed should not be interpreted, or otherwise used, as limiting the scope of the disclosure, including the claims. It is to be fully recognized that the different teachings of the embodiments discussed may be employed separately or in any suitable combination to produce desired results. In addition, one skilled in the art will understand that the description has broad application, and the discussion of any embodiment is meant only to be exemplary of that embodiment, and not intended to intimate that the scope of the disclosure, including the claims, is limited to that embodiment.

Certain terms are used throughout the description and claims to refer to particular features or components. As one skilled in the art will appreciate, different persons may refer to the same feature or component by different names. This document does not intend to distinguish between components or features that differ in name but not function, unless specifically stated. In the discussion and in the claims, the terms "including" and "comprising" are used in an open-ended fashion, and thus should be interpreted to mean "including, but not limited to . . . ." Also, the term "couple" or "couples" is intended to mean either an indirect or direct connection. In addition, the terms "axial" and "axially" generally mean along or parallel to a central axis (e.g., central axis of a body or a port), while the terms "radial" and "radially" generally mean perpendicular to the central axis. The use of "top," "bottom," "above," "below," and variations of these terms is made for convenience, but does not require any particular orientation of the components.

Reference throughout this specification to "one embodiment," "an embodiment," or similar language means that a particular feature, structure, or characteristic described in connection with the embodiment may be included in at least one embodiment of the present disclosure. Thus, appearances of the phrases "in one embodiment," "in an embodiment," and similar language throughout this specification may, but do not necessarily, all refer to the same embodiment.

Although the present invention has been described with respect to specific details, it is not intended that such details should be regarded as limitations on the scope of the invention, except to the extent that they are included in the accompanying claims.

What is claimed is:

1. A downhole well device for positioning within a well having a fluid, comprising:

an outer casing;

an inner casing at least partially located within the outer casing;

seals between the outer and inner casing; wherein a sealed chamber is formed by the outer and inner casings and the seals a substance located within the chamber, wherein the substance is exothermically or endothermically reactive with the fluid; and a sensor located on an outer surface of the outer casing and configured to sense the temperature of the chamber to detect an exothermic reaction or endothermic reaction within the chamber.

2. The device of claim 1, wherein the sensor comprises a temperature sensor, a pressure sensor, or both.

3. The device of claim 1, further comprising a bumper located in the chamber, wherein the substance is located on the bumper or is a part of the bumper.

4. The device of claim 1, wherein the inner casing is movable axially with respect to the outer casing.

5. The device of claim 1, wherein the inner casing comprises a mandrel.

6. The device of claim 1, wherein the substance comprises at least one of an alkali metal and an alkaline earth metal.

7. The device of claim 1, wherein the outer casing is coupled to a downhole tubing string.

8. The device of claim 1, wherein the fluid is water.

9. A downhole well device for positioning within a well having a fluid, comprising:

an outer casing comprising a port;

an inner casing at least partially located within the outer casing;

seals between the inner casing and the outer casing;

a rupture disk located in the port;

a substance located in a space between the rupture disk and the inner casing, wherein the substance is exothermically reactive with the fluid; and a sensor configured to detect an exothermic reaction within the chamber.

10. The device of claim 9, wherein the sensor comprises a temperature sensor, a pressure sensor, or both.

11. The device of claim 10, wherein the sensor comprises a temperature sensor and is located external to the outer casing adjacent the rupture disk and configured to sense the temperature of the space externally.

12. The device of claim 9, wherein the substance comprises at least one of an alkali metal and an alkaline earth metal.

13. The device of claim 9, wherein the substance is located on the rupture disk.

14. The device of claim 9, wherein the inner casing is movable axially with respect to the outer casing.

15. The device of claim 9, wherein the fluid is water.

* * * * *